United States Patent [19]

Martinez, Jr.

[11] 4,201,063

[45] May 6, 1980

[54] METHOD AND APPARATUS FOR CONSERVING ENERGY IN AN AIR CONDITIONING SYSTEM

[76] Inventor: George Martinez, Jr., P.O. Box 1141, Gonzales, La. 70737

[21] Appl. No.: 928,538

[22] Filed: Jul. 27, 1978

[51] Int. Cl.[2] ..... F25B 5/00; F28D 5/00; F25B 1/00

[52] U.S. Cl. ..... 62/117; 62/305; 62/310; 62/498

[58] Field of Search ..... 62/181, 79, 115, 117, 62/119, 238 E, 305, 310, 504, 506, 525, DIG. 2, 218, 219, 174

[56] References Cited

U.S. PATENT DOCUMENTS

| | | | |
|---|---|---|---|
| 1,383,039 | 6/1921 | Uhde . | |
| 2,018,453 | 10/1935 | Lawler . | |
| 2,048,661 | 7/1936 | Lawler . | |
| 2,620,635 | 12/1952 | Mantner et al. | 62/305 |
| 2,712,927 | 7/1955 | Blum . | |
| 2,715,515 | 8/1955 | Stair . | |
| 2,718,766 | 9/1955 | Imperatore et al. | 62/129 |
| 2,875,594 | 3/1959 | Schilling | 62/303 |
| 3,130,557 | 4/1964 | McFarlan | 62/305 |
| 3,191,396 | 6/1965 | Ruddock | 62/115 |
| 3,242,689 | 3/1966 | Chubb et al. | 62/498 |
| 3,259,177 | 7/1966 | Niemann | 165/34 |
| 3,412,569 | 11/1968 | Arledge, Jr. | 62/115 |
| 3,435,631 | 4/1969 | Wood, Jr. | 62/305 |
| 3,498,072 | 3/1970 | Stiefel | 62/118 |
| 3,627,032 | 12/1971 | Glad et al. | 165/32 |
| 3,744,264 | 7/1973 | Ware | 62/115 |
| 3,995,443 | 12/1976 | Iversen | 62/305 |
| 4,102,392 | 7/1978 | Schneider | 62/310 |
| 4,144,722 | 3/1979 | Mattwell | 62/305 |

*Primary Examiner*—Lloyd L. King

*Attorney, Agent, or Firm*—David L. Ray; Edgar E. Spielman, Jr.

[57] ABSTRACT

A method and apparatus for conserving energy in the operation of a conventional air conditioning system in a large building employing a water cooled condenser, an evaporator, a chilled water circuit, and a refrigerant compressor or heat source in an absorption-type air conditioner wherein the compressor or heat source is not energized and the water tubes in the evaporator are connected to the water tubes in the condenser to allow the water from the evaporator to flow directly into the water tubes of the condenser.

19 Claims, 2 Drawing Figures

METHOD AND APPARATUS FOR CONSERVING ENERGY IN AN AIR CONDITIONING SYSTEM

BACKGROUND OF THE INVENTION

The present invention relates to a refrigeration and air conditioning system. In particular, the invention relates to a method and apparatus for saving energy in the operation of a large building air conditioning system.

In large multi-story buildings, air conditioning systems are designed to promote year-round cooling. This characteristic is essential to a cooling system designed for buildings in which the outer peripheral surfaces and areas are subject to wide temperature gradients whereas the inner portions remain relatively stable regardless of the ambient conditions.

Such an air conditioning system must, in general, be operated during substantially the entire year to provide the necessary cooling and air circulation. During mild weather months of the year the system can be operated without the compressor where ambient conditions permit.

Both compression and absorption systems are used to cool large buildings. Absorption refrigeration systems are essentially vapor-compression systems with the compressor replaced by a thermally activated arrangement (heat source). These two air conditioning systems generally use the same design of condenser and evaporator. See the *Standard Handbook for Mechanical Engineers,* Seventh Edition, Theodore Baumeister, Editor, McGraw-Hill Book Company, New York, New York, page 18–12, which is hereby incorporated by reference.

Various methods are disclosed in the art for minimizing the time it is necessary to run the compressor. See, for example, U.S. Pat. Nos. 2,718,766; 3,191,396; 3,242,689; 3,412,569, and 3,744,264.

When the system is run without the compressor or heat source, significant amounts of energy are saved because the compressor or heat source consumes large amounts of energy when they are operating. Therefore, to reduce the amount of energy consumed by the air conditioning system in a building, it is desirable that the time during which the compressor or heat source is operated be minimized.

SUMMARY OF THE INVENTION

In accordance with the present invention there is provided a method and apparatus for saving energy in the operation of and air conditioning system wherein the compressor or heat source is not energized and the water tubes in the evaporator are connected to the water tubes in the condenser to allow the water from the evaporator to flow directly into the water tubes of the condenser.

DESCRIPTION OF THE PREFERRED EMBODIMENTS

Figure 1:
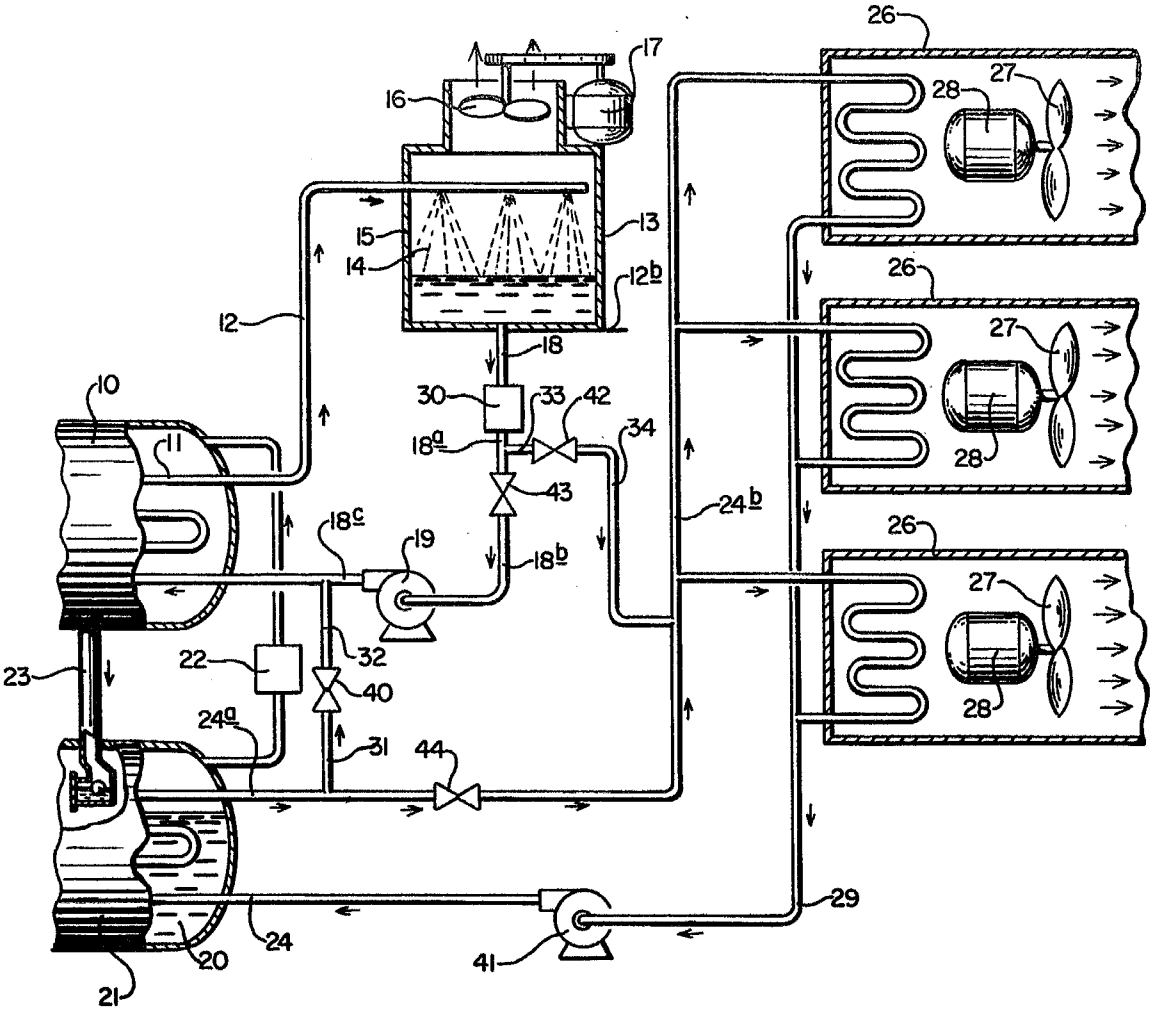
FIG. 1 is a schematic layout of the present invention.

Referring now to FIG. 1, the numeral 10 designates a condenser of the usual building air conditioning unit which has a bundle of water tubes 11 running therethrough and which has an outlet pipe 12 running to the roof **12*b* of the building where it connects to the upper end of the cooling tower 13. The outlet pipe terminates in a series of holes along its bottom edge which form a downward spray 14 in the cooling tower. The cooling tower 13 is a typical cooling tower which has air intake louvers (not shown) in the walls 15 and a suction fan 16 which is operated by motor 17 which draws air upwardly through the spray 14 and out to the open air. When valves 40 and 42 are closed and valve 43 is open, as they would be when the compressor is operating, the water or other liquid thus cooled is pumped back through pipe 18, filter 30, pipe 18*a*, valve 32, pipe 18*b*, pump 19, and into condenser 10 through pipe 18*c*** thereby completing the cycle.

Thus, the water, brine, or other liquid in water tubes 11 in condenser 10 is constantly cooled by the cooling tower so as to cool and liquify the vapors of refrigerant 20 passing into condenser 10 from cooler or evaporator 21 through a compressor 22 of conventional structure connecting one end of cooler 21 to the adjoining end of condenser 10. The compressor 22 is of usual and conventional construction and is not shown in detail. The words "cooler" and "evaporator" as used herein both refer to 21.

The cooler 21 is also connected to condenser 10 by a float trap 23 of usual and conventional construction through which the refrigerant 20 can pass in only one direction from condenser 10 into the cooler 21. A bundle of chill water tubes 24 are mounted in the lower half of cooler 21 so as to run its entire length. The chill water tubes 24 are covered by refrigerant 20 which fills only the lower half of cooler 21.

The tubes carrying the chilled water or brine leave the cooler 21 through pipe **24*a* as indicated by the arrow when valves 40 and 42 are closed and valves 44 and 43 are open, as they would be when the compressor 22 is operating. The chilled water then passes through valve 44 into pipe 24*b* and passes in parallel through room cooling units 26 equipped with fans 27 driven by motors 28 in the direction indicated by the arrows. The chilled water is then returned by pipe 29 through pump 41 into pipe 24 and cooler 21**, thereby completing the cycle.

In normal operation on a hot day in order to secure peak chilling of the water circulted from cooler 21 through pipes **24*a*, 24*b*, cooling units 26, and pipes 29 and 24, it is necessary to run compressor 22 to build up pressure and condense the refrigerant vapors from the cooler or evaporator 21 to liquify the vapors. The liquified refrigerant 20 is then returned through float trap 23 to the cooler 21. During this cycle valves 40 and 42 are closed, valves 43 and 44** are opened, and the system is operating as a conventional air conditioning system for a building.

The apparatus of the present invention includes, in addition to the normal or conventional building air conditioning system and its conventional components, pipes 31 and 32 which are controlled by valve 40 and connect pipe **24*a* with pipe 18*c*, water tubes 11, and condenser 10; pipes 33 and 34 which are controlled by valve 42 and connect pipe 18*a* with pipe 24*b* and cooling units 26, pipe 29, and cooling tubes 24; valves 43 and 44 which are closed when the system is operated in accordance with the present invention, and valves 40 and 42 which are open when the system is operated in accordance with the invention. A filter 30 may be placed in line 18** if desired.

In practicing the method of the invention, the cooling tower fan 16 and the chill water pump 41 are set in operation after compressor 22 is turned off, valves 40 and 42 are opened, valves 43 and 44 are closed, and pump 19 is turned off. The cooling cycle is then as follows:

Pump 41 forces warm return water from room cooling units 26 through tubes 24 and condenser 21, outwardly through pipe 24*a* and into pipe 31, through open valve 40 into pipes 32 and 18*c*. Water from pipe 32 flows outwardly through tube 11 and into pipe 12 and on to cooling tower 13. Cool water from cooling tower 13 flows through pipe 18, filter 30, and into pipe 18*a*. Valve 43 is closed and therefore prohibits fluids from passing therethrough. Water travels through pipe 18*a*, open valve 42, and into pipe 34. From pipe 24 cool water travels onwardly through pipe 24*b* into room cooling units 26 and returns to pump 41 through pipe 29.

Thus when ambient conditions permit, the water or other cooling medium is cooled by the cooling tower and introduced directly to the room cooling units 26, commingling with the water therein. Thus, the time during certain ambient conditions when it is necessary to run the compressor to achieve the desired temperatures inside the building is minimized. Conventional automatic controls can be utilized to operate the system, or the system can be operated manually.

Figure 2:
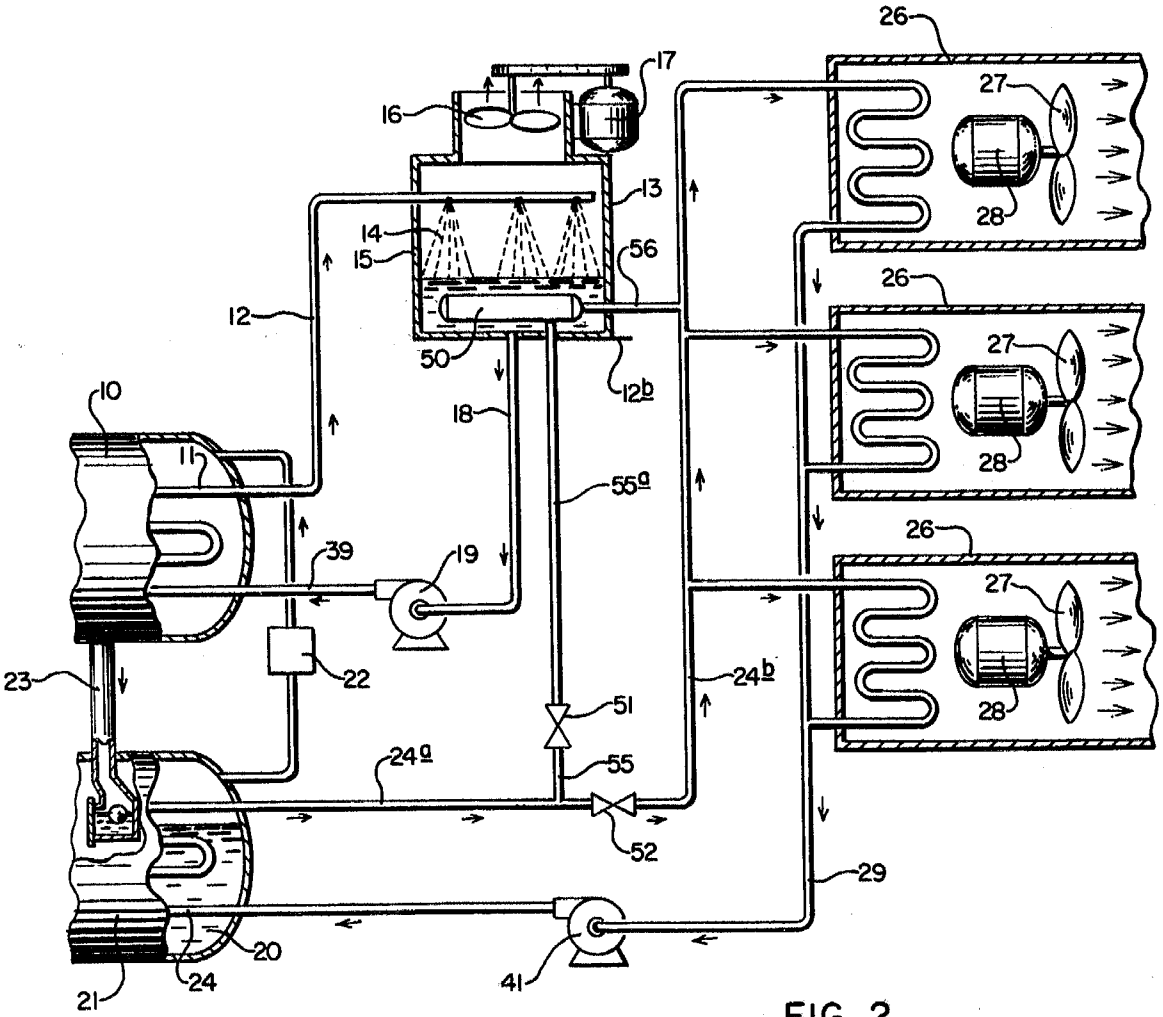
FIG. 2 is a schematic layout of another embodiment of the present invention.

An alternate embodiment of the present invention is shown in FIG. 2. In this embodiment a heat exchanger 50 is placed in cooling tower 13 and the water from the chill water circuit is directed through heat exchanger 50.

Heat exchanger 50 may be any conventional heat exchanger attached to the cooling tower 13 so that the major portions or all of the heat exchanger is beneath the liquid level within the cooling tower. In this embodiment of the present invention there is no interchange of water between the water tubes of the condenser and the water tubes of the evaporator.

Referring to FIG. 2, the numeral 10 designates a condenser of the usual building air conditioning unit which has a bundle of water tubes 11 running therethrough and which has an outlet pipe 12 running to the roof 12*b* of the building where it connects to the upper end of the cooling tower 13. The outlet pipe terminates in a series of holes along its bottom edge which form a downward spray 14 in the cooling tower. The cooling tower 13 is a typical cooling tower which has air intake louvers (not shown) in the walls 15 and a suction fan 16 which is operated by motor 17 which draws air upwardly through the spray 14 and out to the open air. Natural draft cooling towers without fans may also be utilized. The water thus cooled is pumped back through pipe 18, pump 19, and into condenser 10 and tubes 11 through pipe 39, thereby completing the cycle.

Thus the water in water tubes 11 in condenser 10 is constantly cooled so as to cool and liquify the vapors of refrigerant 20 passing into condenser 10 from cooler or evaporator 21 through a compressor 22 of conventional structure connecting one end of cooler 21 to the adjoining end of condenser 10. The compressor 22 is of usual and conventional construction and is not shown in detail.

The cooler 21 is also connected to condenser 10 by a float trap 23 of usual and conventional construction through which the refrigerant 20 can pass in only one direction from condenser 10 into the cooler 21. A bundle of chill water tubes 24 are mounted in the lower half of cooler 21 so as to run its entire length. The chill water tubes 24 are covered by refrigerant 20 which fills only the lower half of cooler 21.

The tubes 24 carrying the chilled water or brine leave the cooler 21 through pipe 24*a*, as indicated by the arrow, when valve 51 is closed and valve 52 is open, as they would be when the compressor 22 is operating. The chilled water then passes through valve 52 into pipe 24*b* and passes in parallel through room cooling units 26 equipped with fans 27 driven by motors 28 in the direction indicated by the arrows. The chilled water is then returned by pipe 29 through pump 41 into pipe 24 and cooler 21, thereby completing the cycle.

In normal operation on a hot day in order to secure peak chilling of the water circulated from cooler 21 through pipes 24*a*, 24*b*, cooling units 26, and pipes 29 and 24, it is necessary to run compressor 22 to build up pressure and condense the refrigerant vapors from the cooler or evaporator 21 to liquify the vapors. The liquified refrigerant 20 is then returned through float trap 23 to the cooler 21. During this cycle valve 51 is closed, valve 52 is open, and the system is operating as a conventional air conditioning system for a building.

The embodiment of the present invention shown in FIG. 2 includes, in addition to the normal or conventional building air conditioning system and its conventional components, a heat exchanger 50 in cooling tower 13 and lines 55, 55*a*, and 56 which are controlled by valve 51 and connect line 24*a* with heat exchanger 50. In practicing the method of the invention, the cooling tower fan 16 and the chill pump 41 and pump 19 are set in operation after compressor 22 is turned off, valve 50 is opened and valve 52 is closed. The cooling cycle is then as follows:

Pump 41 forces warm return water from room cooling units 26 through tubes 24 and condenser 21, outwardly through pipe 24*a* and into pipe 55, through open valve 51 into pipe 55*a* and into heat exchanger 50. Water from heat exchanger 50 flows outwardly through pipe 56 and into pipe 24*b* into room cooling units 26 and returns to pump 41 through line 29. Thus, when ambient conditions permit, the water or other cooling medium is cooled by the heat exchanger 50 in the cooling tower, thereby minimizing the time durin certain ambient conditions when it is necessary to run the compressor to achieve the desired temperatures inside the building.

As is known to those skilled in the art, some air conditioning systems substitute a nozzle arrangement for the float assembly 23 whereby refrigerant is injected into a circuit of tubes in the evaporator, rather than injecting the refrigerant into the body of the evaporator shell. Vaporous refrigerant is removed from the tubes in the evaporator by the compressor 22. The chill water is in turn injected into the body of the evaporator shell. The present invention is applicable to such a nozzle arrangement as would be obvious to those skilled in the art.

Also, as is known to those skilled in the art, rather than using a shell and tube arrangement, a tube-in-tube arrangement can be utilized to effect heat transfer between the refrigerant and the water circuit. The present invention is applicable to such a tube-in-tube arrangement as would be obvious to those skilled in the art.

It will be understood that any recognized source of cold water, or any other conventional cooling source, may be used instead of the cooling tower 13 such as cold well water as is generally used in installations where it is available. A cold well water source will increase the heat transfer rate between the refrigerant 20 and the chill water and tube bundle 24 sufficiently to obtain the required temperature of the chilled water.

Both embodiments of the invention would be applicable to a compression-type air conditioning system as shown in the drawings, or to an absorption-type air conditioning system (not shown) as is obvious to those skilled in the art. Replacement of the compressor 22 with a pump, an absorber, and a thermally activated arrangement (heat source) such as the system disclosed on page 18–12 of the *Standard Handbook for Mechanical Engineers* would not alter the operation or apparatus of the invention. A pump is used in the absorption system to circulate refrigerant between the evaporator and the condenser.

It is believed that the invention and many of its attendant advantages will be understood from the foregoing description and it will be apparent that various changes may be made in the form, construction, and arrangement of the parts without departing from the spirit and scope of the invention. The form hereinbefore described is merely a preferred embodiment thereof.

What is claimed:

1. An air conditioning system comprising:

a. condenser means;

b. evaporator means;

c. cooling tower means;

d. cooling unit means;

e. means for conveying liquid refrigerant from said condenser means to said evaporator means;

f. means for conveying refrigerant from said evaporator means to said condenser means;

g. first liquid circuit means for circulating liquids between said evaporator means and said cooling unit means;

h. second liquid circuit means for circulating liquids between said condenser means and said cooling tower means;

i. means for connecting said first liquid circuit means to said second liquid circuit means to permit said liquids in said first liquid circuit means and said liquids in said second liquid circuit means to commingle and flow through said first and said second liquid circuit means.

2. The air conditioning system of claim 1 wherein said means for conveying refrigerant from said evaporator means to said condenser means comprises compressor means.

3. The air conditioning system of claim 1 wherein said means for conveying refrigerant from said evaporator means to said condenser means comprises pump means.

4. The air conditioning system of claim 1 wherein said means for connecting said first liquid circuit means to said second liquid circuit means comprises pipe means and valve means.

5. The air conditioning system of claim 1 wherein said first liquid circuit means comprises pipe means partially contained in said evaporator means and in said cooling unit means located in the area to be cooled, said pipe means being adapted for conveying a liquid medium to be cooled between said evaporator means and said cooling unit means, said liquid medium being heated in said cooling unit means and cooled in said evaporator means.

6. The air conditioning system of claim 5 wherein said second liquid circuit means comprises pipe means partially contained in said condenser means and in said cooling tower means located in the area to be cooled, said pipe means being adapted for conveying a liquid medium to be cooled between said condenser means and said cooling tower means, said liquid medium being cooled in said cooling tower means and heated in said condenser means.

7. An air conditioning system comprising:

a. condenser means;

b. evaporator means;

c. cooling tower means;

d. cooling unit means;

e. heat exchanger means located in said cooling tower means;

f. means for conveying liquid refrigerant from said condenser means to said evaporator means;

g. means for conveying refrigerant from said evaporator means to said condenser means;

h. first liquid circuit means for circulating liquids between said evaporator means and said cooling unit means;

i. second liquid circuit means for circulating liquids between said condenser means and said cooling tower means; and, j. means for connecting said first liquid circuit means to said heat exchanger means to permit said liquids in said first liquid circuit means to be conveyed to and circulated through said heat exchanger means.

8. The air conditioning system of claim 7 wherein said means for conveying refrigerant from said evaporator means to said condenser means comprises compressor means.

9. The air conditioning system of claim 7 wherein said means for conveying refrigerant from said evaporator means to said condenser means comprises pump means.

10. The air conditioning system of claim 7 wherein said means for connecting said heat exchanger means to said first liquid circuit means comprises pipe means and valve means.

11. The air conditioning system of claim 7 wherein said first liquid circuit means comprises pipe means partially contained in said evaporator means and in said cooling unit means located in the area to be cooled, said pipe means being adapted for conveying a liquid medium to be cooled between said evaporator means and said cooling unit means, said liquid medium being heated in said cooling unit means and cooled in said evaporator means.

12. The air conditioning system of claim 11 wherein said second liquid circuit means comprises pipe means partially contained in said condenser means and in cooling tower means located in the area to be cooled, said pipe means being adapted for conveying a liquid medium to be cooled between said condenser means and said cooling tower means, said liquid medium being cooled in said cooling tower means and heated in said condenser means.

13. A method for conserving energy in an air conditioning system having condenser means, evaporator means, cooling tower means, cooling unit means, first liquid circuit means for circulating liquids between said evaporator means and cooling unit means, second liquid circuit means for circulating liquids between said condenser means and said cooling tower means, means for conveying liquid refrigerant from said condenser means to said evaporator means, and means for conveying refrigerant from said evaporator means to said condenser means, comprising:

a. de-energizing said means for conveying refrigerant from said evaporator means to said condenser means;

b. connecting said first liquid circuit means to said second liquid circuit means to permit said liquids in said first liquid circuit means and said liquids in said second liquid circuit means to commingle and flow through said first and said second liquid circuit means; and, c. circulating said liquids in said first liquid circuit means and said second liquid circuit means through said first and said second liquid circuit means.

14. The air conditioning system of claim 13 wherein said means for conveying refrigerant from said evaporator means to said condenser means comprises compressor means.

15. The air conditioning system of claim 13 wherein said means for conveying refrigerant from said evaporator means to said condenser means comprises pump means.

16. The air conditioning system of claim 13 wherein said means for connecting said first liquid circuit means to said second liquid circuit means comprises pipe means and valve means.

17. A method for conserving energy in an air conditioning system having condenser means, evaporator means, cooling tower means, cooling unit means, first liquid circuit means for circulating liquids between said evaporator means and cooling unit means, second liquid circuit means for circulating liquids between said condenser means and said cooling tower means, means for conveying liquid refrigerant from said condenser means to said evaporator means, means for conveying refrigerant from said evaporator means to said condenser means, and heat exchanger means located in said cooling tower means, comprising:

a. de-energizing said means for conveying refrigerant from said evaporator means to said condenser means;

b. connecting said first liquid circuit means to said heat exchanger means to permit said liquids in said first liquid circuit means to be conveyed to and circulated through said heat exchanger means; and, c. circulating said liquids in said first liquid circuit means through said heat exchanger means.

18. The air conditioning system of claim 17 wherein said means for conveying refrigerant from said evaporator means to said condenser means comprises compressor means.

19. The air conditioning system of claim 17 wherein said means for conveying refrigerant from said evaporator means to said condenser means comprises pump means.

* * * * *